US005083400A

United States Patent [19]

Bowman

[11] Patent Number: 5,083,400

[45] Date of Patent: Jan. 28, 1992

[54] ADJUSTABLE THRESHOLD AND DOOR SILL

[76] Inventor: Howard Bowman, 4030 Lore Rd. #6, Anchorage, Ala. 99507

[21] Appl. No.: 605,779

[22] Filed: Oct. 29, 1990

[51] Int. Cl.[5] ..... E06B 1/70

[52] U.S. Cl. ..... 49/468; 49/481; 49/482; 49/488

[58] Field of Search ..... 49/468, 470, 469, 467, 49/488, 482, 481, 306

[56] References Cited

U.S. PATENT DOCUMENTS

| | | | |
|---|---|---|---|
| 377,838 | 2/1888 | Pratt | 269/488 |
| 600,984 | 3/1898 | Wilson | 49/468 |
| 1,422,569 | 7/1922 | Hammes | 49/481 |
| 1,595,827 | 8/1926 | Frisque | 49/468 |
| 1,837,959 | 12/1931 | Gaskin et al. | 49/482 |
| 4,123,875 | 11/1978 | Herschberg | 49/482 |
| 4,320,598 | 3/1982 | Rodak et al. | 49/488 X |

FOREIGN PATENT DOCUMENTS

| | | | |
|---|---|---|---|
| 2660 | of 1908 | United Kingdom | 49/481 |

*Primary Examiner*—Philip C. Kannan
*Attorney, Agent, or Firm*—Michael J. Tavella

[57] ABSTRACT

A new door threshold/weatherstripping device is disclosed that uses rollers, installed either in a door to contact a threshold surface, or in the threshold to contact the door. The rollers are supported by bearings that permit the rollers to turn freely as the door is opened or closed. The bearings are mounted in housings that have adjustable, spring loaded pistons. These pistons permit the spacing of rollers with respect to the threshold (or door) to be adjusted to ensure a tight seal. In the embodiment that utilizes a threshold mounted roller, a gripper pad is used to prevent the roller from turning when a person steps on it. This prevent possible slipping injuries. Both embodiments have brushes mounded adjacent to the rollers to clean them of dirt, snow and water.

9 Claims, 3 Drawing Sheets

ADJUSTABLE THRESHOLD AND DOOR SILL

This invention is related to adjustable door thresholds and particularly, to self-leveling thresholds installed in doors.

BACKGROUND OF THE INVENTION

Door sweeps and thresholds provide a weather tight seal at the base of exterior doors. With the arrival of the energy crisis of the 1970's, improvements have been made to door thresholds to make them more energy efficient. One of the biggest difficulty in maintaining a tight weather seal at an entrance door is the wear placed on the weatherstripping (door sweep) placed along the bottom of the door. As this material is compressed over time, gaps can form between the sill and the sweep or the stripping can tear, which allows cold air to pass under the door. To overcome this problem, several designs have been developed. Some representative designs are found in U.S. Pat. Nos. 3,475,866, 3,762,100, 4,003,162, 4,104,830, 4,287,684, 4,352,258, 4,387,535, and 4,565,033. All of these patents adjust the height of the sill in some manner to correct for the compression of the door sweep. These devices also allow a builder to adjust the height of the sill quickly when the door is being installed. Over time, as the door sweep loses its tight seal, the homeowner can readjust the sill as needed. Eventually, the door sweep no longer provides an adequate seal regardless of the adjustments made to the sill. When that occurs, the door sweep must be replaced and the sill re-adjusted. Although these maintenance procedures are not difficult, they are often overlooked or put off because they can be tedious. If ignored, however, the gap in the threshold seal can waste considerable amounts of energy in northern climates.

BRIEF DESCRIPTION OF THE INVENTION

The present invention overcomes the difficulties present in the threshold designs discussed above. The invention consists of a cylindrical tube that runs the entire length of the bottom of a door. The tube is designed to be placed within an opening that is cut into the base of the door. The opening is cut deep enough so that only a small portion of the tube is exposed. The tube is covered with a felt cover. A cleaning brush is mounted adjacent to the tube to prevent dirt, water and snow from entering the opening. The tube is mounted on bearings and is self leveling. The bearings allow the tube to turn, which allows the tube to seat beneath the door with the surface of the cylinder stopping at a different position every time the door is opened or closed. This acts to prevent premature wear on the weather seal, which results in fewer adjustments to ensure a tight seal.

The device can be installed in the top of the door, the bottom of the door, or the threshold, these options allow the device to be installed in almost every known door-threshold installation. This device, therefore, can be used in retrofit applications, providing additional energy conservation with a minimum installation in existing homes, as well as for providing a convenient method for new construction applications.

It is an object of this invention to provide a self leveling door threshold that can be installed in commercially available doors with a minimum of modification to the door.

It is another object of this invention to provide a self leveling door threshold that can be readily adjusted using ordinary tools.

It is yet a further object of this invention to provide a weather seal that minimizes wear on the weather seal surface, thereby reducing the need for adjustments to the weather seal or threshold.

DETAILED DESCRIPTION OF THE INVENTION

Figure 1:
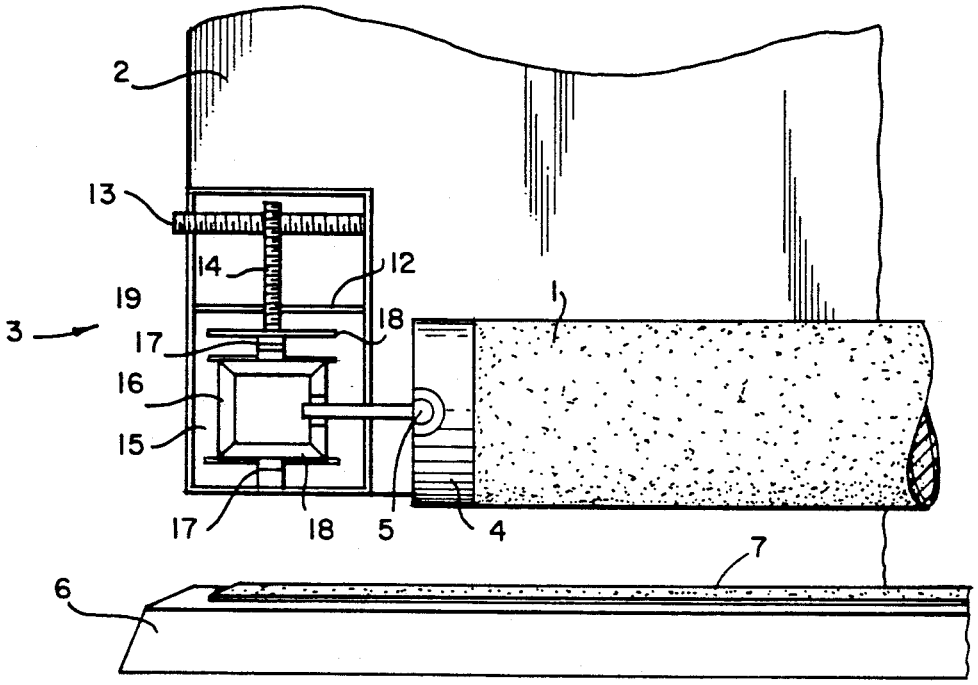
FIG. 1 is a detail view of the device as installed in a typical door.
Figure 7:
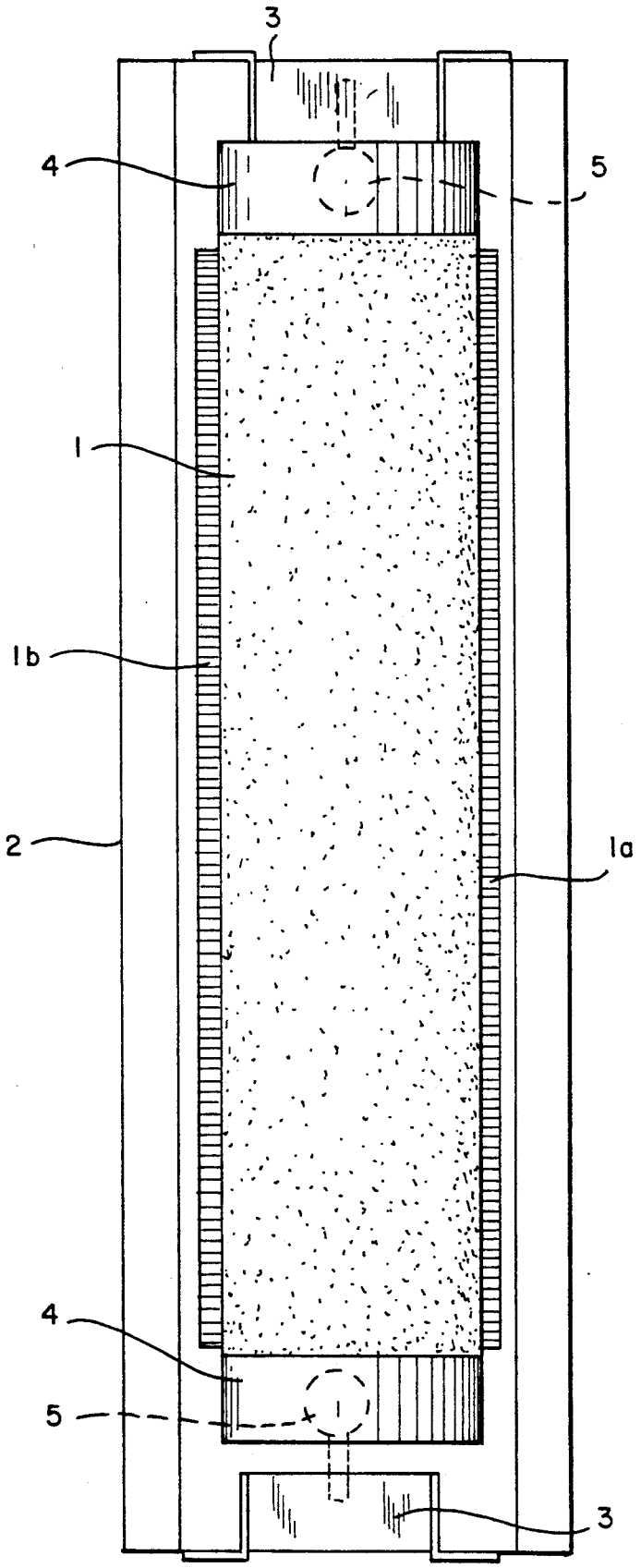
FIG. 7 is a detail view of the bottom of the door showing the placement of the first embodiment within the door.

Referring now to the drawings, and particularly to FIGS. 1 and 7, the invention consists of a rotating cylinder 1 that is mounted in a door 2. The cylinder 1, in the preferred embodiment, is a ⅝ inch PVC bar that is urethane filled and wrapped with felt. Of course, any other suitable material can be substituted. Metal bars, however, are considered inferior, although they can be used, because metal is a poor insulator. The cylinder 1 is placed in a groove 1*a* cut into the bottom of the door 2 (see FIG. 7). The groove 1*a* is cut wide enough to allow the cylinder 1 to turn freely and to accommodate cleaning brushes 1*b* as shown in FIG. 7. These brushes are used to clean water and snow from the cylinder to prevent dirt and moisture from clogging the mechanism. The groove 1*a* extends the entire length of the door bottom as shown.

The height adjustment-leveling mechanism 3 is designed to fit within one corner of the groove at both edges of the door 2 (see FIG. 7). This mechanism will be discussed in greater detail below.

The ends of the cylinder 1 are fitted with teflon coated cylindrical blocks 4 that are recessed in the center to permit a bearing 5 to seat with in the blocks 4 (note: there is one block placed on each end of the cylinder 1).

The bearings 5 are designed to allow the cylinder 1 to rotate when the cylinder 1 contacts the threshold 6. For clarity, the threshold 6 is shown at a greater distance than would occur in practice. Under normal conditions, The cylinder 1 would protrude approximately ¼ inch below the door 2 and would rest against the threshold 6. The top of the threshold is covered with a felt weather stripping 7 that cleans the cylinder 1 and provides enough frictional force to ensure that the cylinder 1 rotates against the threshold 6.

Figure 2:
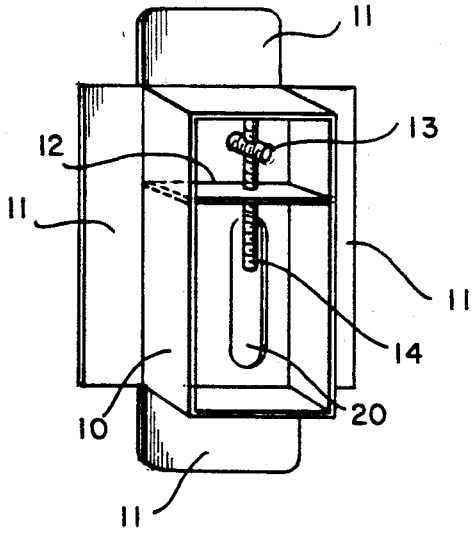
FIG. 2 is a front view detail of the height adjustment mechanism.

Referring now to FIGS. 1 and 2, the adjuster-self leveler mechanism 3 consists of a housing 10 that contains the mechanism. A plurality of tabs 11 are placed around the perimeter of the housing 10 to secure the housing 10 to the door. The housing 10 has a plate 12 placed as shown. The plate 12 protects the inner mechanism from contamination from dirt, water and snow that might enter the housing 10 through the adjustment port, which is an opening in the housing wall that allows access to the adjustment screw 13. The adjustment screw 13 is actually part of a worm gear assembly and is mounted in the housing so that it can rotate with some level of tension, to prevent the adjustment screw 13 from rotating freely and causing the device to go readily out of adjustment. A leveling screw 14 is placed perpendicular to the adjustment screw 13 as shown. Together, the adjustment screw 13 and the leveler screw 14 form the worm gear assembly. The leveler screw 14 passes through a hole in plate 12 into the adjustment chamber 15. A spring loaded piston 16 (which is not shown in FIG. 2 to allow the adjustment slot 20 to be shown) is placed within the adjustment chamber 15. The bearing 5 is fixedly connected to the piston 16 as shown. In the preferred embodiment, the piston 16 is a TEFLON block.

The piston 16 is secured in the adjustment chamber 15 by a first spring 17, which is attached to the base of the housing 10 and a second spring 17 that is attached to the top of piston 16 as discussed below. The piston 16 has two mounting plates 18, attached to the top and the bottom of the piston 16, as shown that hold the springs 17. A third plate 19 connects the top spring 17 and the leveler screw 14.

As shown in FIG. 2, an adjustment slot 20 is provided in the housing. The adjustment slot 20 permits the bearing 5 to move vertically within the door 2, which in turn adjusts the height of the cylinder 1 within the door 2. Relatively large adjustments are made by turning the adjustment screw 13, which in turn will raise or lower the leveler screw 14, the bearing 5, and ultimately, the cylinder 1. The springs 17 allow the cylinder to move within the door 2 in minor amounts as weather conditions change the characteristics of the wood in the door. The springs 17 also act as shock absorbers when the door is closed to prevent the cylinder from becoming damaged.

Figure 3:
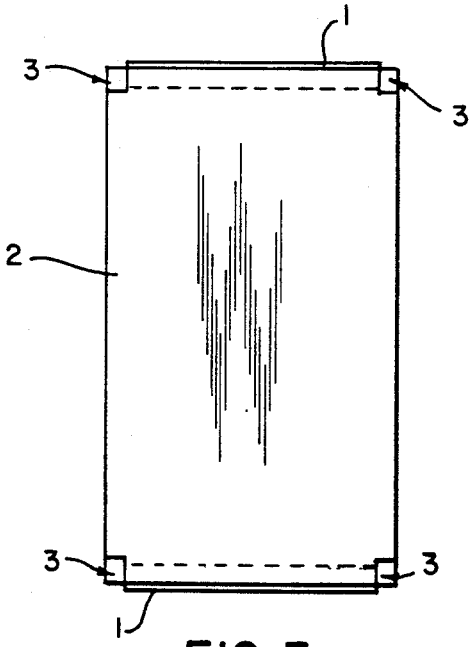
FIG. 3 is a representational view of a door showing the placement of the major components.

In practice, an adjustor/self lever-mechanism is placed in each side of the door, both top and bottom, as shown in FIG. 3. Placing the device in both the top and bottom of the door provides a greater degree of insulation. The device can be installed in both new doors or in older doors, already installed in homes. To make the installation, a groove is cut in both the top and the bottom of the door that corresponds to the size of the cylinder 1. Additional cuts are made at the corners 30 as shown on FIG. 7, to accommodate the adjustment mechanisms. Once the device is installed in the door it can readily be adjusted to the proper height with adjusting screw 13 until a good, tight seal is formed between the threshold and the door.

The Second Embodiment

Figure 4:
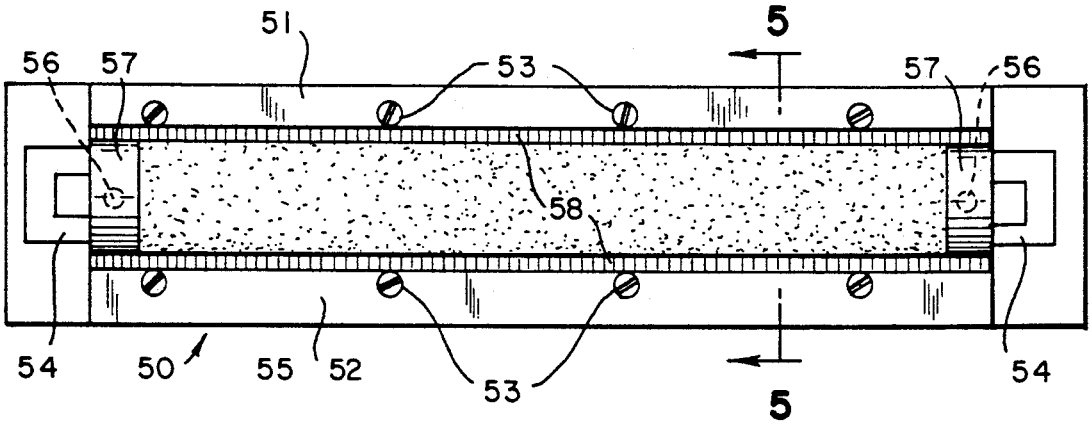
FIG. 4 is a top view of the second embodiment of the invention.
Figure 5:
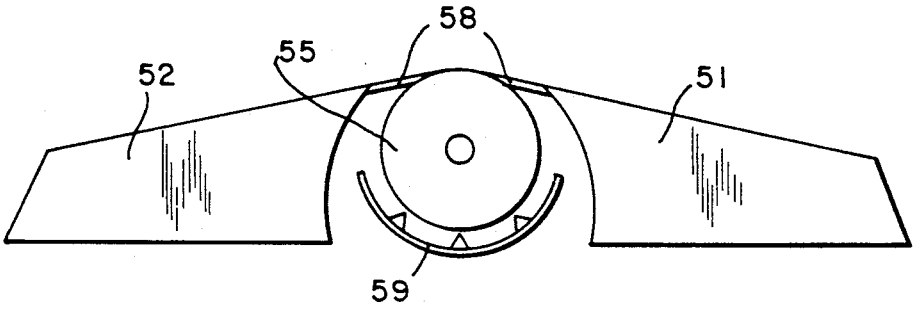
FIG. 5 is a side view of the second embodiment along the lines 5—5 of FIG. 4.
Figure 6:
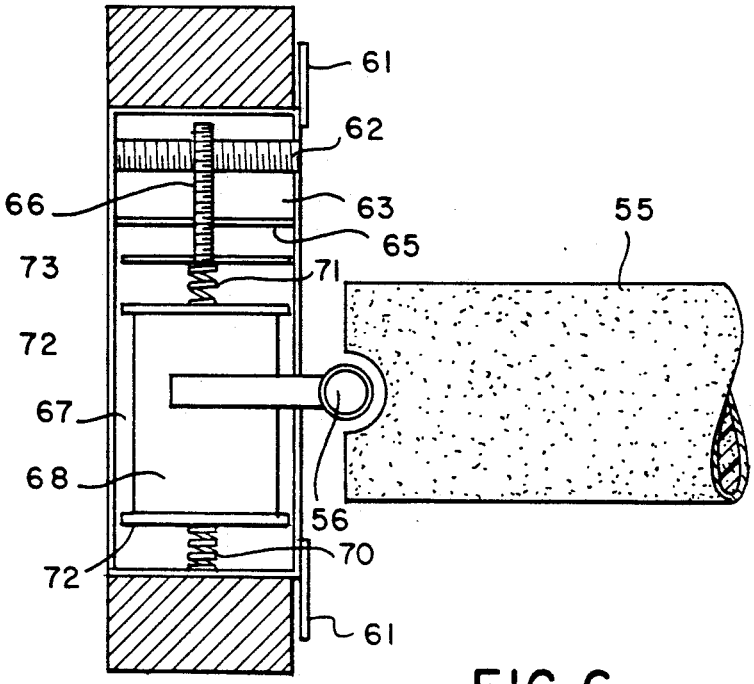
FIG. 6 is a enlarged detail view of the bearing-adjustment assembly of the second embodiment, showing the placement within the door frame.

Referring now to FIGS. 4, 5 and 6, a second embodiment of the invention is shown. In this embodiment, the rotating cylinder is placed in the threshold, rather than the door. FIG. 4 is a top view of the second embodiment. A threshold frame 50 is formed of two angular plates 51 and 52 as shown. The plates 51 and 52 are secured to the subfloor by screws 53 or other means common to the art. At each end of the frame 50 is an adjustment mechanism 54, which are installed in receptacles provided in the frame 50.

A rotating cylinder 55 is placed in the center opening of the threshold frame 50 as shown (see FIG. 4). The rotating cylinder is similar in construction to that of the first embodiment, except that cylinder 55 is typically a larger diameter. The cylinder rotates on two bearings 56 which are placed in the end caps 57. The construction of the end caps 57 is similar to that of the first embodiment.

To prevent dirt, snow and water from entering the space between the frame 50 and the cylinder 55, two felt or rubber wipers 58 are placed in the ends of the frame 50 as shown. To prevent the cylinder from rotating when people step on it (creating a dangerous slipping hazard), a gripper pad 59 is placed under the cylinder 55. Under normal conditions, the cylinder 55 is designed to contact the gripper pad 59 lightly when the door is closed. The adjustment mechanisms 54 prevent the cylinder 55 from being pushed down against the gripper pad 59, so the cylinder 55 will rotate. Under the weight of a person, however, the cylinder 55 will be pushed down sufficiently against the gripper pad 59 to prevent the cylinder 55 from turning, thereby eliminating a slipping hazard. This hazard is eliminated when the device is installed in the doors and, therefore, the gripper pad is not needed in that embodiment.

As in the case of the first embodiment, two adjustment mechanisms 54 are used to level and adjust the device. The adjustment mechanisms in this embodiment are similar to those in the first embodiment, except the housing and adjustment screws are modified because of the mounting requirements. Referring now to FIGS. 5 and 6, the adjuster mechanisms 54 are placed within the door frame in this embodiment, rather than being placed in the door. Accordingly, the housing 60 must be changed to locate the mounting ears 61 on the opposite side of the housing. Similarly, the adjusting screw 62 is reversed to allow access from the cylinder side of the housing. The adjustment port 63 is also reversed.

The remainder of the adjustment mechanism is the same as that of the first embodiment. The housing 55 has a plate 65 placed as shown. The plate 65 protects the inner mechanism from contamination from dirt, water and snow that might enter the housing 55 through the adjustment port 63, which is an opening in the housing wall that allows access to the adjustment screw 62. The adjustment screw 62 is actually part of a worm gear assembly and is mounted in the housing so that it can rotate with some level of tension, to prevent the adjustment screw 62 from rotating freely and causing the device to go readily out of adjustment. A leveling screw 66 is placed perpendicular to the adjustment screw 62 as shown. Together, the adjustment screw 62 and the leveler screw 66 form the worm gear assembly. The leveler screw 66 passes through a hole in plate 65 into the adjustment chamber 67. A spring loaded piston 68 (which is not shown in FIG. 3 to allow the adjustment slot 63 to be shown) is placed within the adjustment chamber 67. The bearing 56 is fixedly connected to the piston 68 as shown.

The piston 68 is secured in the adjustment chamber 67 by a spring 70, which is attached to the base of the housing 67 and a second spring 71 that is attached to the top of piston 68 as discussed below. The piston 68 has two mounting plates 72, attached to the top and the bottom of the piston 68, as shown that hold the springs 70 and 71. A third plate 73 connects the top spring 71 and the leveler screw 66.

An adjustment slot 63 is provided in the housing. It is identical in construction to slot 20 as shown in FIG. 3. The adjustment slot 63 permits the bearing 56 to move vertically within the threshold, which in turn adjusts the height of the cylinder 55. Relatively large adjustments are made by turning the adjustment screw 62, which in turn will raise or lower the leveler screw 66, the bearing 56, and ultimately, the cylinder 55. The springs 70 and 71 allow the cylinder 55 to move within the threshold in minor amounts as weather conditions change the characteristics of the wood in the threshold. The springs 70 and 71 also act as shock absorbers when the door is closed, or people walk on the threshold, to prevent the cylinder from becoming damaged.

The device is used automatically every time a door is opened. There are no special operating techniques to use the device. The device is installed in a different manner depending on the embodiment. For the first embodiment, as discussed above, the door is taken off the hinges and grooves are cut into the bottom and the top of the door (see FIG. 7) to accept the cylinders. The corners of both the top and the bottom are also routed out to hold the adjustment mechanisms. The cylinder is then measured, and if necessary, is cut to the proper length (if the cylinder is cut, one of the protective caps must be removed and then reinstalled after the cut is made. The cylinder is then placed within the groove and the adjustment mechanisms are set in their respective cutouts. The adjustment mechanisms are then secured to the door using screws or similar fasteners. The door can then be rehung and the final adjustments can be made. With the door closed, the gap, if any, is checked and the adjustment screws are then turned until the cylinder is set at the proper spacing on the top and bottom of the door. Once these adjustments are made, re-adjustments are needed only periodically.

In the second embodiment, a different procedure is needed. First, the door is removed from the hinges. The existing threshold is then removed and the frame is cleared of debris. The replacement threshold is then measured and the door frame is cut to accept the width and depth of the new threshold. The door frame is then cut on both sides to accept the adjustment mechanisms. The threshold is then placed in the prepared opening and secured into place using appropriate hardware. The device to cause the adjustment mechanisms to fit into the precut openings when the device is placed and set. Small screws are used to secure the adjustment mechanism cases to the door frame. Once the threshold frame is set and leveled, it will automatically adjust to slight variations of clearance due to warping and temperature changes.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A self leveling door threshold for installation in a door having a top and a bottom and a set thickness, and being mounted in a frame, comprising:

a) a roller rotatably installed within the bottom of said door such that the axis of rotation is parallel to the bottom of said door;

b) a pair of housings, fixedly installed in the bottom of the door and being oppositely disposed, with the roller being placed therebetween, said housings each having a bearing extending outwardly from said housing, said bearings also being fixedly attached to a piston mounted on springs within the housings to permit the piston to be displaced slightly upward or downward, said piston being fixedly attached to a worm gear mechanism, such that as the worm gear mechanism is turned, the piston is displaced upwards or downwards over a greater distance than is possible to achieve with said springs; and c) a pair of bearing races, fixedly attached to the roller and being oppositely displaced thereon.

2. The self leveling door threshold of claim 1 further comprising: brush means fixedly attached to said door such that the brush means contact the roller as the roller is turned, thereby cleaning said roller.

3. A self leveling door threshold comprising:

a) a door having a top and a bottom and having two sides and a front and a back, and being generally rectangular, said front facing the exterior of a building when the door is closed and said back facing the interior of a building when the door is closed, said sides being between said front and back of the door and providing the door with some thickness, said top having a channel therein running parallel to the front and back of said doors, said channel having a thickness less than that of said sides, said bottom also having a channel therein running parallel to the front and back of said doors, said channel having a thickness less than that of said sides;

b) a first roller means rotatably installed with the channel in the bottom of the door, said first roller means having journal means extending outwardly therefrom, said journal means of said first roller means being set in bearings to permit free rotation of said roller means;

c) first adjustment means being fixedly installed within said door having a pair of housings, fixedly installed in the bottom of the door and being oppositely disposed, with the roller being placed therebetween, said housings each having a bearing extending outwardly from said housing, said bearings also being fixedly attached to a piston mounted on springs within the housings to permit the piston to be displaced slightly upward or downward, said piston being fixedly attached to a worm gear mechanism, such that as the worm gear mechanism is turned, the piston is displaced upwards or downwards over a greater distance than is possible to achieve with said springs, and a pair of bearing races, fixedly attached to the roller and being oppositely displaced thereon;

d) a second roller means rotatably installed with the channel in the top of the door, said second roller means having journal means extending outwardly therefrom, said journal means of said second roller means being set in bearings to permit free rotation of said second roller means;

e) second adjustment means being fixedly installed within said door having a pair of housings, fixedly installed in the bottom of the door and being oppositely disposed, with the roller being placed therebetween, said housings each having a bearing, extending outwardly from said housing, said bearings also being fixedly attached to a piston, mounted on springs within the housings to permit the piston to be displaced slightly upward or downward, said piston being fixedly attached to a worm gear mechanism, such that as the worm gear mechanism is turned, the piston is displaced upwards or downwards over a greater distance than is possible to achieve with said springs, and a pair of bearing races, fixedly attached to the roller and being oppositely displaced thereon.

4. The self leveling door threshold of claim 3 further comprising: brush means fixedly attached to said door such that the brush means contact the first roller as the first roller is turned, thereby cleaning said first roller.

5. The self leveling door threshold of claim 4 further comprising: brush means fixedly attached to said door such that the brush means contact the second roller as the second roller is turned, thereby cleaning said second roller.

6. A self levelizing door threshold for use in a door frame having a door comprising:

a) A frame being generally rectangular having a length greater than width, said frame being fixedly installed in a door frame, said frame also having a channel placed therein said channel being parallel to the door when said door is closed and aligned therewith;

b) a roller, rotatably installed with said channel such that said roller is free to rotate;

c) adjustment means to set and maintain the spacing between said roller and said door;

d) locking means to prevent the free rotation of said roller when a person steps on said roller.

7. The self leveling door threshold of claim 6 further comprising: brush means fixedly attached to said door such that the brush means contact the roller as the roller is turned, thereby cleaning said roller.

8. The device of claim 6 wherein said locking means comprise a gripper pad, fixedly placed beneath said roller such that when sufficient weight is placed on said roller, the roller is pushed against said gripper pad and is restrained from rotating.

9. The device of claim 8 wherein said gripper pad comprises a rubber sheet having a plurality of nodules protruding therefrom such that said nodules contact the roller when said roller is placed within said threshold.

* * * * *